US007217094B2

(12) United States Patent
Cunha et al.

(10) Patent No.: US 7,217,094 B2
(45) Date of Patent: May 15, 2007

(54) AIRFOIL WITH LARGE FILLET AND MICRO-CIRCUIT COOLING

(75) Inventors: Frank J. Cunha, Avon, CT (US); Jason E. Albert, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 203 days.

(21) Appl. No.: 10/967,558

(22) Filed: Oct. 18, 2004

(65) Prior Publication Data

US 2006/0083614 A1 Apr. 20, 2006

(51) Int. Cl.
*F01D 5/18* (2006.01)

(52) U.S. Cl. ..... 416/97 R; 416/193 A

(58) Field of Classification Search ..... 416/97 R, 416/115, 193 A; 415/115
See application file for complete search history.

(56) References Cited

U.S. PATENT DOCUMENTS 4,515,526 A 5/1985 Levengood
5,382,133 A 1/1995 Moore et al.
5,975,851 A * 11/1999 Liang ..... 416/97 R
6,290,463 B1 * 9/2001 Fargher et al. ..... 416/97 R
6,406,260 B1 6/2002 Trindade et al.
7,063,506 B2 * 6/2006 Davison et al. ..... 416/97 R
2003/0108423 A1 6/2003 Morgan et al.
2005/0265840 A1 * 12/2005 Levine et al. ..... 416/97 R

FOREIGN PATENT DOCUMENTS

| | | |
|---|---|---|
| EP | 1 013 877 | 6/2000 |
| EP | 1 128 024 | 8/2001 |
| EP | 1 262 631 | 12/2002 |
| GB | 872705 | 7/1961 |

* cited by examiner

*Primary Examiner*—Ninh H. Nguyen
(74) *Attorney, Agent, or Firm*—Marjama & Bilinski LLP

(57) ABSTRACT

A gas turbine engine blade has a relatively large fillet to improve the characteristics of the air flow thereover. The fillet has a thin wall which partially defines a fillet cavity therebehind, and cooling air is provided to the fillet cavity and is then routed to the outer surface by way film cooling holes. Various design features are provided to enhance the effectiveness of the cooling air being provided to both the fillet cavity and other cavities within the blade.

32 Claims, 7 Drawing Sheets

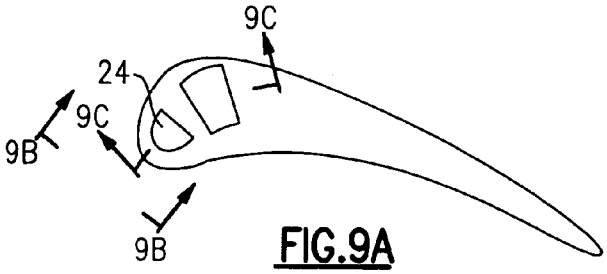
FIG.9A
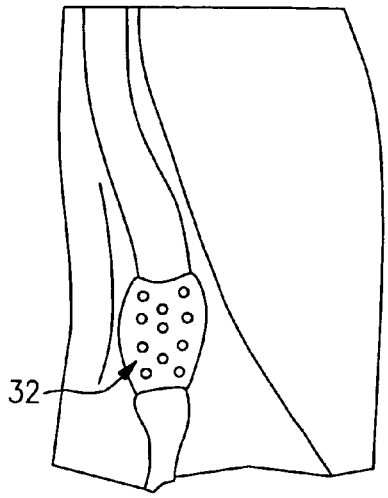
FIG.9B
FIG.9C
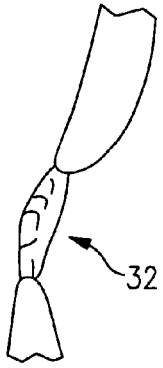
FIG.10
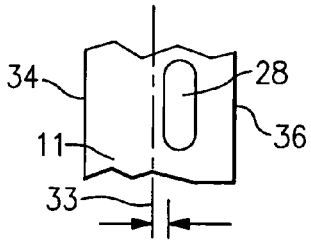
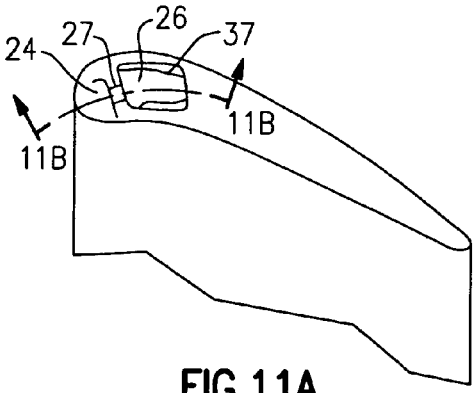
FIG.11A
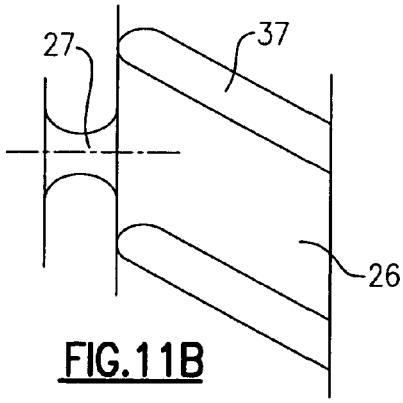
FIG.11B

AIRFOIL WITH LARGE FILLET AND MICRO-CIRCUIT COOLING

BACKGROUND OF THE INVENTION

This invention relates generally to turbine blades, and more particularly, to turbine blades with a large fillet and associated cooling features.

Present turbine blade design configurations include little or no leading edge fillets at the transition between the blade and the associated platform. As a result, several gas path vortices are developed in this region so as to cause hot gases to be trapped in certain areas of the airfoil, thereby resulting in severe distress to those regions.

One way to alleviate the problem is to introduce large fillets that have a substantial radius such that the gas path vortices are substantially eliminated. A large fillet on the other hand, will tend to add metal and therefore mass to the blade. Such an increase in thermal mass in a fluid area would have negative effects in terms of centrifugal loading and thermal stress fatigue and creep. It is therefore desirable to not only substantially increase the fillet radius but also to reduce the mass that is associated with a larger fillet, and to also provide proper cooling for this area.

SUMMARY OF THE INVENTION

Briefly, in accordance with one aspect of the invention, the thickness of the relatively large fillet is minimized to reduce its mass while a dedicated radial passage is introduced to pass cooling air over the back side of the fillet and leading edge before venting through a series of film holes.

In accordance with another aspect of the invention, the dedicated radial passage introduces the flow of coolant air so as to impinge at the base of the fillet area and flow upwardly over a series of cooling features such as hemispherical dimples, before exiting from leading edge film holes.

In accordance with another aspect of the invention, the ceramic core which ties the supply and leading edges cores and when removed forms impingement cooling passages between the internal cavities of the blade, are replaced with a refractory metal core which involves a very small core height with features such as pedestals that can be lasered in the core to enhance heat transfer.

In accordance with another aspect of the invention, the cross-over holes between the internal cavities is modified from a circular shape to a race-track shape for better target wall coverage.

In accordance with another aspect of the invention, the placement of the leading edge impingement cross-over holes are off-set from the mid plane toward the pressure side of the blade.

By yet another aspect of the invention, trip strips are included in the impingement feed cavity, and the impingement cross-over holes are located substantially between adjacent trip strips so as to avoid interference between the structures.

In accordance with another aspect of the invention, the entrance to the leading edge fed passage is bell-mouthed in shape in order to enhance the flow characteristics of the cooling air.

In accordance with another aspect of the invention, the radial gap between the leading edge showerhead holes and the fillet showerhead holes is reduced to enhance the cooling effect thereof.

By yet another aspect of the invention, the discrete laser holes are replaced with forward-diffused shaped holes to increase the film cooling coverage and reduce the potential for plugged holes with adverse impacts on local metal temperatures.

By yet another aspect of the invention, the feed holes are metered so as to provide for desirable flow control.

By yet another aspect of the invention, a trench is provided on the inner surface of the leading edge so as to take better advantage of the cooler portion of the air stream.

By another aspect of the invention, micro-circuit internal features are used to uniformly distribute and reduce cooling flow, and micro-circuit pedestals are used to serve as conduction paths and flow turbulence promoters while offering structural integrity to the micro-circuit inside the large fillet.

In the drawings as hereinafter described, preferred and alternate embodiments are depicted; however, various other modifications and alternate constructions can be made thereto without departing from the true spirit and scope of the invention.

BRIEF DESCRIPTION OF THE DRAWINGS

FIGS. 9A–9C show the use of micro-circuit cores in the blade leading edge fillet area in accordance with the present invention.

FIG. 10 shows the location of the cross-over holes in accordance with an embodiment of the present invention.

FIGS. 11A and 11B show another embodiment of the cross-over hole location in accordance with the present invention.

DESCRIPTION OF THE PREFERRED EMBODIMENT

Figure 1A:
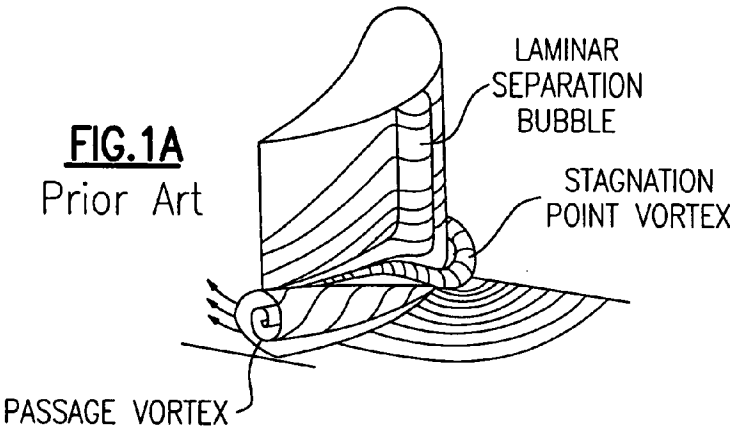
FIG.1A Prior Art
FIGS. 1A and 1B are schematic illustrations of vortex flow models for turbine blades in accordance with the prior art.
Figure 1B:
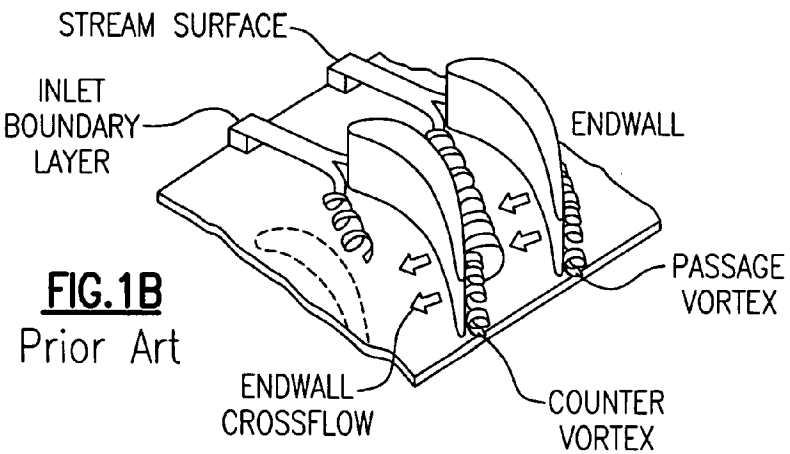
FIG.1B Prior Art

Referring now to FIGS. 1A and 1B, there is shown an artists conception of a vortex structure that results from the flow of hot gases over a turbine blade having no fillet (i.e. with the blade portion intersecting with the platform section at substantially an orthogonal angle). Here, it will be seen, that because of laminar separation that occurs, secondary flow vortices are formed such that hot gases can be trapped on the suction side of the airfoils as shown and these can then result in severe distress in these regions.

Figure 2:
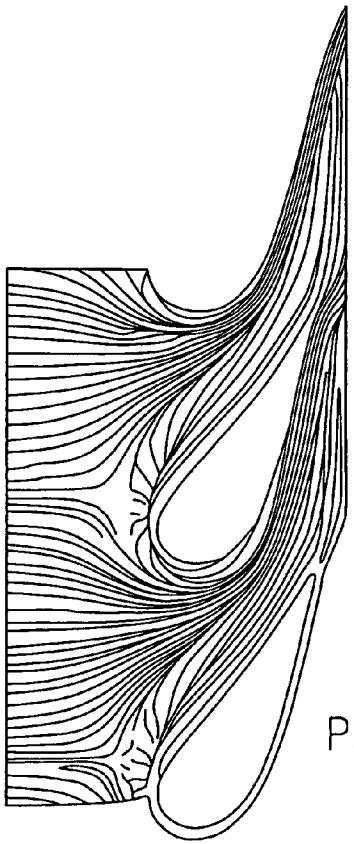
FIG.2 Prior Art
FIG. 2 is a top view of a turbine blade showing the streamlines flowing therearound in accordance with the prior art.

In FIG. 2, there is shown a computational fluid dynamics simulation of the streamlines of gases passing around an airfoil having little or no fillet as discussed hereinabove. Here again, there is evidence of secondary flow vortices that tend to affect the thermal load to the airfoil.

Figure 3A:
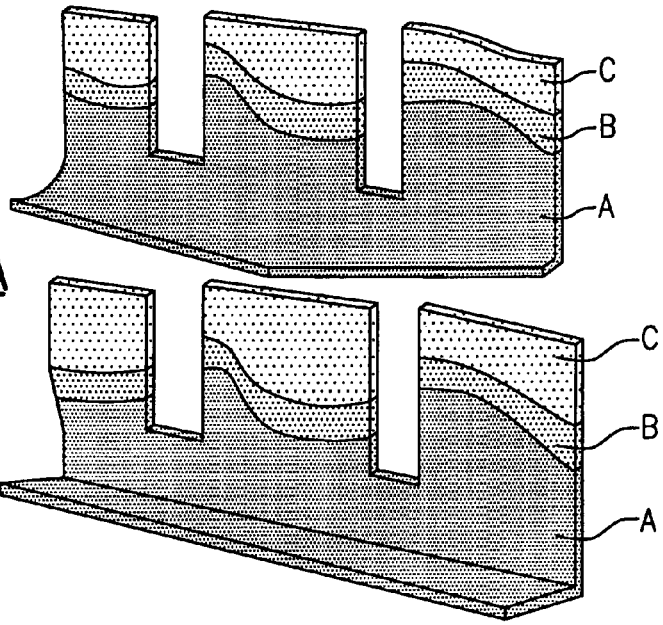
FIG. 3A shows comparisons of gas temperature reductions between large and small fillet blades.

In an effort to address the problems discussed hereinabove, the airfoil was modified to include a leading edge fillet with a substantial radius. For example, present blade design configurations use leading edge fillets to the blade platforms with a radius, or offset, in the range of 0.080 inches or less. In accordance with the present design of increased fillet size, a fillet is provided having a radius that may be as high as a quarter of the size of the entire radial span or about ⅜ inches or higher. This modification has been found to improve the flow characteristics of the airfoil and to thereby substantially reduce the temperatures in the fillet region. For example, in FIG. 3A, there is shown a color code indication of temperatures in three gradations, A, B and C for both an airfoil with no fillet (at the bottom) and one with a large fillet (at the top). In each of these, the cooler range of temperatures is shown by the darker colors A at the bottom and the hotter temperature ranges are shown by the lighter colors C at the top. As will be recognized, the gas temperatures flowing over the modified airfoil (i.e. with a fillet) has a substantially greater portion in the cooler zone A than the airfoil without the fillet. This is the result of the fillet tending to suppress the end wall vortices.

Figure 3B:
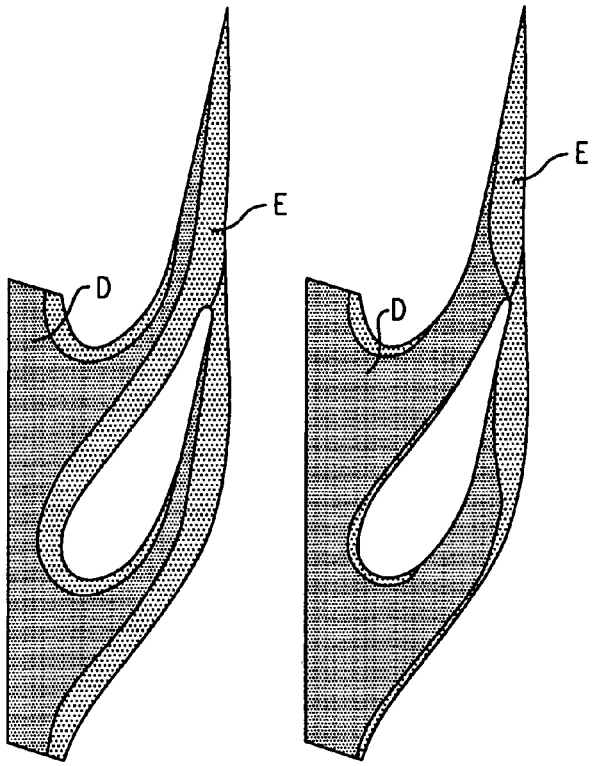
FIG. 3B shows comparisons of adiabatic wall temperatures between large and small fillet blades.

Similarly, in FIG. 3B, wherein there is shown a comparison of adiabatic wall temperatures between an airfoil having no fillet (as shown at the left) and one with the fillet (as shown at the right). In each case, the darker portion D is indication of cooler temperature range and the lighter portion E is indicative of a higher temperature range. Again, it will be seen that the adiabatic wall temperatures of the airfoil having a fillet are substantially reduced from those of the airfoil having no fillet.

Although the use of larger fillets successfully addresses the problem of the secondary flow vortices as discussed hereinabove, the use of such large fillets can also introduce other problems associated with the design and use of an airfoil. Generally, it will be understood that the introduction of a larger fillet will also increase the amount of metal that is in the airfoil. This substantial increase in the mass in the area of the fillet could have a negative effect in terms of centrifugal loading and thermal stress, fatigue and creep. The present invention therefore addresses this problem by reducing the mass of the larger fillet blade and providing for various cooling features that have been found effective in cooling the large fillet leading edges.

Figure 4A:
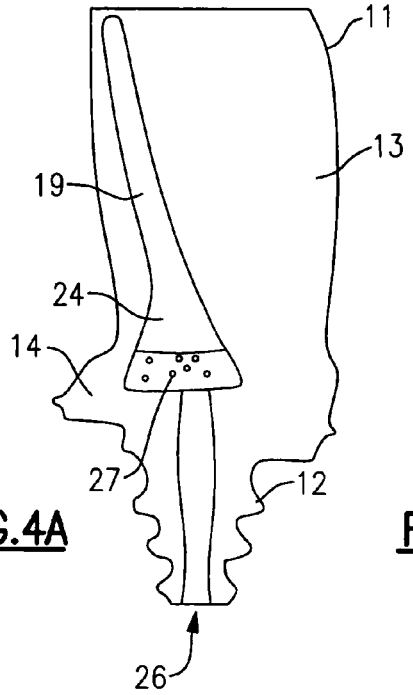
FIGS. 4A and 4B are cut away views of a large fillet blade in accordance with the present invention.
Figure 4B:
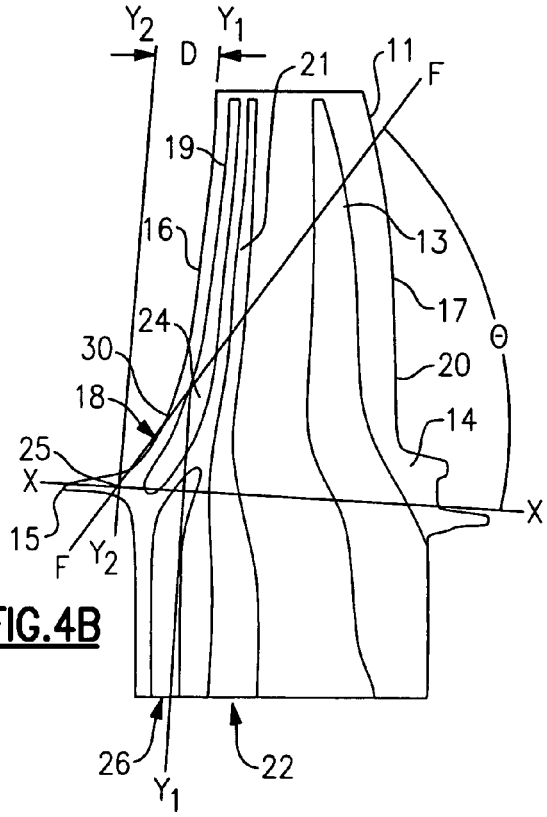

Referring now to FIGS. 4A and 4B, wherein a turbine blade 11 is shown in a front view and a side view, respectively, the turbine blade 11 has a fir tree 12 for attaching the blade 111 to a rotating member such as a disk, an airfoil portion 13 and a platform 14 having a leading edge 15 and a trailing edge 20 that define a plane x—x. The airfoil portion 13 has a pressure side (i.e. concave side) and a suction side (i.e. convex side), a leading edge 16 that defines a plane $Y_1$—$Y_1$ that is substantially orthogonal to plane x—x and a trailing edge 17. At the point where the leading edge 16 transitions into and is attached to a platform 14, there is a relatively large-radius fillet 18 that extends from a point 25 on the platform 14 to a point 30 on the leading edge 16 as shown. The distance D defines the offset between the plane $Y_1$—$Y_1$ and a plane $Y_2$—$Y_2$ that is parallel to plane $Y_1$—$Y_1$ and passes through point 25. A fillet line F—F extending between points 25 and 30 and forming a fillet angle of θ defines the extent of the fillet 18. In accordance with the present invention the large fillet 18 is defined by the parameters D and θ with the offset D being in the range of 0.080" to 0.375" and the fillet angle θ being in the range of 10° to 60°. It is this large radius fillet that overcomes the problems of end wall vortices as discussed hereinabove.

As is conventional in these types of blades, there is provided behind the leading edge wall a leading edge cavity 19, and parallel to that is a coolant supply cavity 21. The coolant supply cavity 21 is supplied with a source of cooling air that flows up through the radial passage 22 which passes through the fir tree 12. The coolant supply cavity 21 is fluidly connected to the leading edge cavity 19 by a plurality of impingement cooling passages 23. These impingement cooling passages 23 are formed during the casting process by the insertion of small ceramic core rods which are subsequently removed to leave the impingement cooling passages 23. Thus, the cooling air passes through the radial passage 22 and into the coolant supply cavity 21. It than passes through the impingement cooling passages 23 and into the leading edge cavity 19 where it impinges on the inner surface of the leading edge before being discharged to the outside of the blade by way of film holes. In accordance with one aspect of the present invention, the leading edge cavity 19 extends downwardly toward the platform 14 into an expanded fillet cavity 24 directly behind the fillet 18. There is further provided a dedicated fillet feed passage 26 that extends radially up through the fir tree 12 as shown. The fillet feed passage 26 is fluidly connected to the fillet cavity 24 by a cross-over openings 27.

In operation, cooling air is introduced into the fillet feed passage 26, passes through the cross-over openings 27 and into the fillet cavity 24 to cool the fillet 18 prior to being discharged through film holes (not shown).

Figure 6A:
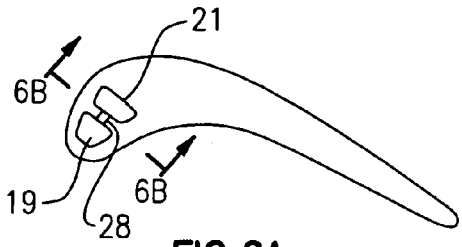
FIGS. 6A and 6B show features of the cross-over holes in accordance with the present invention.
Figure 6B:
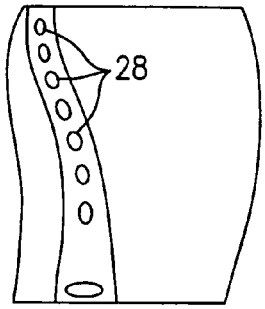

Heretofore, the impingement cooling passages 23 have been circular in cross sectional form. We have found that if these passages are elongated in the radial direction to a racetrack form as shown in FIG. 6B, better target wall coverage will be obtained as the cooling air passes through these passages to flow into the leading edge cavity 19.

Figure 5A:
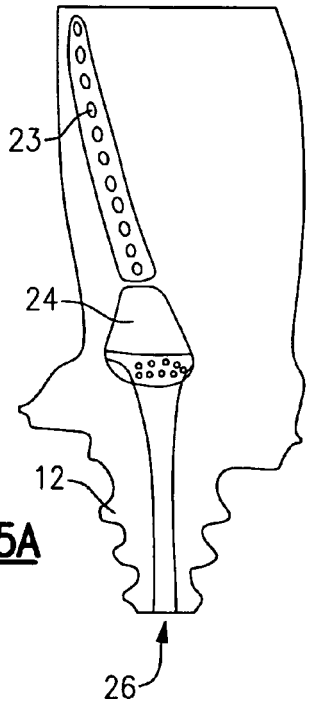
FIGS. 5A and 5B are illustrations of an alternate embodiment thereof.
Figure 5B:
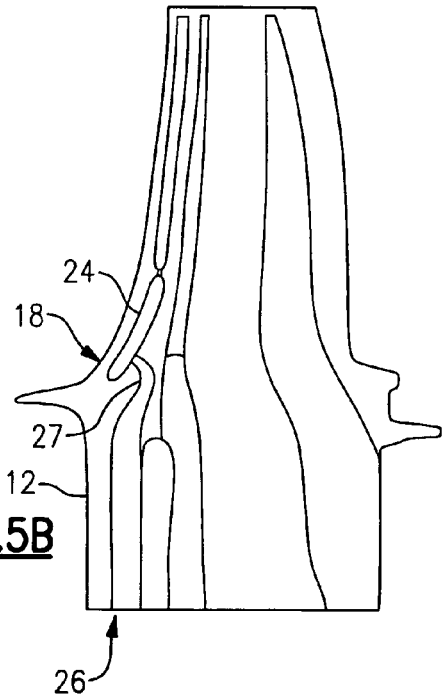
Figure 7:
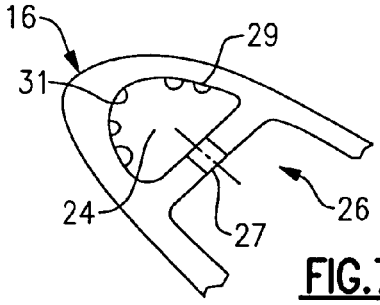
FIG. 7 shows the placement and use of dimples in accordance with an embodiment of the present invention.

Referring now to FIGS. 5A and 5B, an alternate embodiment is shown to again include a dedicated fillet feed passage 26 extending radially up through the fir tree 12 and through a cross-over opening 27. As in the FIGS. 4A and 4B embodiments, the cross-over opening 27 interconnects with a fillet cavity 24. However, the coolant flow is directed to impinge at the base of the fillet area and flow upwards over a series of cooling features, such as hemispherical dimples before exiting by way of leading edge film holes. Such a design is shown in FIG. 7 wherein a plurality of dimples 29 are formed on the inner surface 31 of the airfoil leading edge 16 as shown. These dimples provide for an enhanced cooling effect of the leading edge in the fillet region.

Figure 8A:
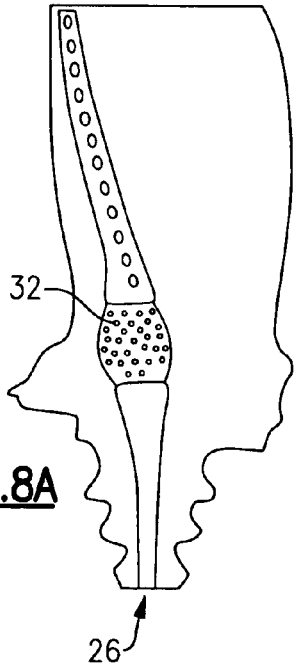
FIGS. 8A and 8B are illustrations of another alternative embodiment of a large fillet blade in accordance with the present invention.
Figure 8B:
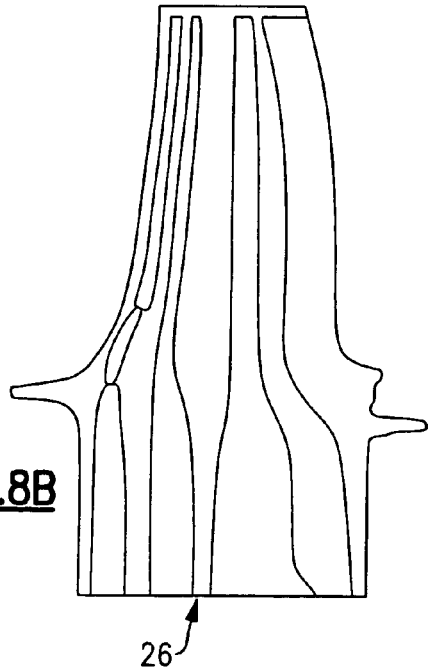

An alternative embodiment of the present invention is shown in FIGS. 8A and 8B wherein, rather than the ceramic core which ties the supply and leading edge cores as discussed hereinabove with respect to the FIGS. 4A and 4B embodiment, the supply and leading edge cores are connected with a refractory metal core (RMC) 32. These features are more clearly shown in FIGS. 9A–9C. The RMC 32 allows for very small core height with features, such as pedestals, lasered in the core to enhance heat transfer. The advantage of this configuration is that of increased heat transfer which is due to enhanced impingement at the fillet cavity 24.

Another feature to enhance cooling characteristics is shown in FIG. 10. Here it will be recognized that the common approach for the placement of the impingement cooling passages is mid-way, or on the mid-plane 33, between the suction side 34 and the pressure side 36 of the blade 11. In the present design, however, the impingement cooling passages 28 are off-set towards the pressure side 36 as shown. This results in improved cooling by taking advantage of the Coriolis forces that result from rotation of the blade.

The use of trip strips in a flow passage is a common way to enhance the flow and cooling characteristics in an airfoil. A pair of such trip strips 37 are shown in FIGS. 11A and 11B as applied to the fillet feed passage 26. We have recognized that the placement of the cross-over opening 27 can be critical in preventing the interference that the trip strips may have on the flow to the cross-over opening 27. Accordingly, the cross-over opening 27 is preferably placed in a position substantially intermediate between a pair of adjacent trip strips 37 as shown. This same concept is equally applicable to the placement of the impingement cooling passages 28 with respect to trip strips that may be placed in the coolant supply cavity 21.

Figure 12:
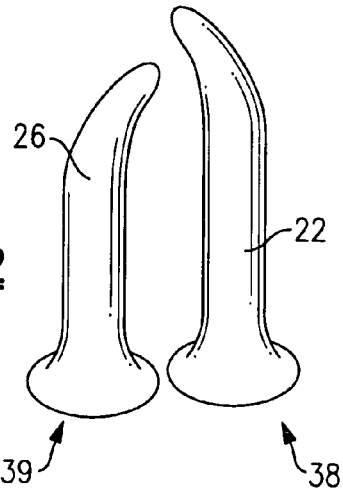
FIG. 12 shows the entrance at the bottom of the leading edge feed passage in accordance with one embodiment of the invention.

Referring now to FIG. 12, another feature to enhance cooling characteristics is shown. Here, both the radial feed passage 22 and the fillet feed passage 26 has a bell shaped inlet as shown at 38 and 39, respectively. These bell shaped inlet openings have been found to decrease the resistance and the pressure losses of the airflow into the passages and thereby increase the amount of cooling effect that can be obtained.

Figure 13:
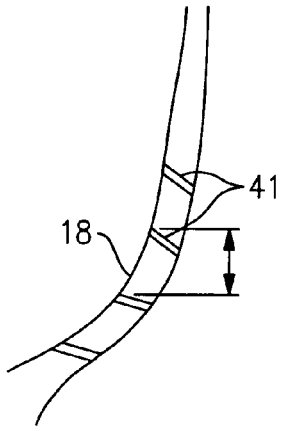
FIG. 13 shows the relationship between the leading edge showerhead holes and the fillet showerhead holes in accordance with one embodiment of the invention.
Figure 14A:
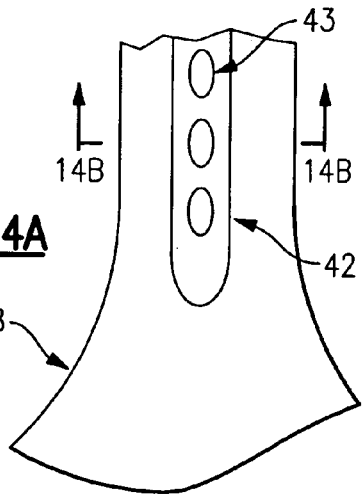
FIGS. 14A–14D show the shaped holes and an associated trench in accordance with an embodiment of the present invention.
Figure 14B:
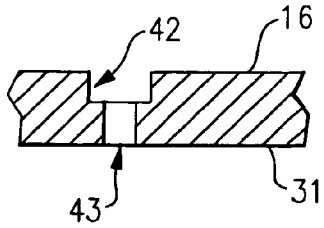
Figure 14C:
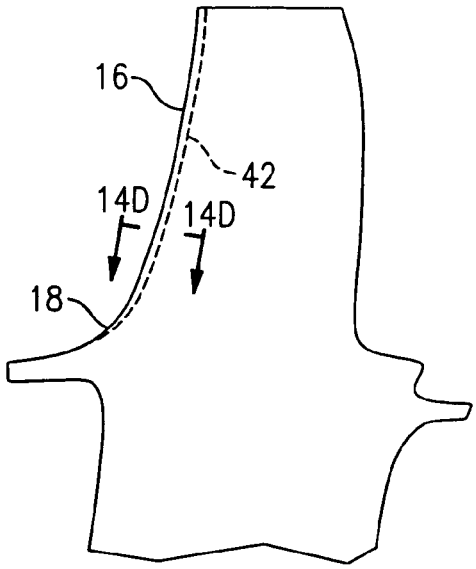
Figure 14D:
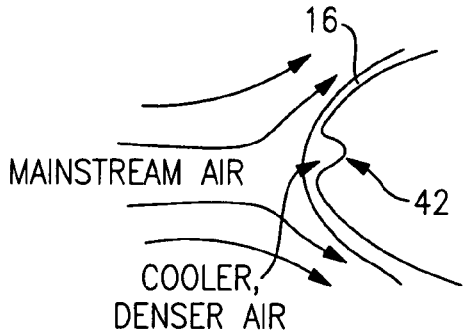

The function of the film holes that conduct the cooling air from leading edge cavity 19 and the fillet cavity 24 to the leading edge 16 of the blade has been discussed hereinabove. The radial spacing of these film holes has generally been uniform along the leading edge 16 of the blade. In FIG. 13, these film holes as shown at 41 are not parallel as is generally the case for those connecting the leading edge cavity 19 to the leading edge of the blade 16. Instead, they are canted to accommodate their individual positions along the curve of the fillet 18 as shown. In addition to this canting of the film holes 41, we have recognized that, unlike the cooling holes in the principal portion of the blade, the film holes 41 are preferably placed closer together so as to increase the number of film holes 41 for a given length along the fillet 18. For example, the typical spacing between film holes (i.e. the pitch between the center of adjacent holes) on the principal portion of the blade is in the area of two times the diameter of the film holes, whereas the spacing of the film holes 41 along the fillet are preferably in the range of one-and-one half times the diameter of the film holes.

Shown in FIGS. 14A–14D, is an alternative embodiment of the film cooling holes at the leading edge of the blade and of the fillets. Here, a trench 42 is formed in the leading edge 16 and extends down to and transitions into the fillet 18 as shown. A plurality of film holes 43 then interconnects the inner surface 31 of the leading edge 16 to the trench 42 as shown. Preferably, the film holes 43 are formed with a cross sectional shape that is a racetrack shape rather than a round shape as discussed hereinabove. The affect of the trench is to allow the cooling air to pass through the film holes and fill the trench before spilling over onto the surface of the leading edge 16.

Figure 15:
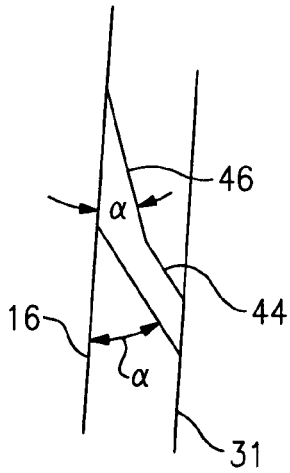
FIG. 15 shows the use of metering holes at the feeds for flow control.

Referring now to FIG. 15, a further modification of the film holes can be made such that their shape, when extending from the inner surface 31 to the leading edge 16, includes a metering portion 44 and a diffusion portion 46. The metering potion 44 is preferably cylindrical or racetrack in cross-sectional form, and the diffusion portion 46 is conically shaped as shown to enhance the cooling effect of the cooling air flowing therethrough. The diffusion portion 46 will then discharge its cooling air to the trench 42 as described hereinabove.

The angles of these portions may, of course, be varied to meet the requirement of the particular application. Typical values may be, for example, an angle $\alpha$ of 20° and an angle $\beta$ of 14°.

While the present invention has been particularly shown and described with reference to preferred and alternate embodiments as illustrated in the drawings, it will be understood by one skilled in the art that various changes in detail may be effected therein without departing from the true spirit and scope of the invention as defined by the claims.

We claim:

1. A gas turbine engine component comprising:

a fir tree for mounting the component to a rotatable disk;

a platform connected to said fir tree and extending in a first plane between a leading edge and a trailing edge;

an airfoil interconnected to said platform by a fillet extending at an acute angle from said platform first plane to a leading edge of the airfoil extending along a second plane substantially orthogonal to said first plane to form a fillet cavity within said airfoil; and cooling means within said component to provide cooling air to said fillet cavity wherein the extent of said fillet is defined by an offset distance defined by the distance between a first point in which the fillet intersects with said first plane and a second point in which the fillet intersects with said second plane as measured along a plane parallel the said first plane, and further wherein the offset distance is in the range of 0.080" to 0.375".

2. A gas turbine engine component as set forth in claim 1 wherein said acute angle is in the range of 10° to 60°.

3. A gas turbine engine component as set forth in claim 1 wherein said cooling means includes a dedicated radial passage for conducting the flow of cooling air through said fir tree and into said fillet cavity.

4. A gas turbine engine component as set forth in claim 3 wherein said radial passage is interconnected to said fillet cavity by one or more cross-over passages.

5. A gas turbine engine component as set forth in claim 3 wherein said fillet cavity has a plurality of projections formed on its inner surface to be cooled by said cooling air.

6. A gas turbine engine component as set forth in claim 5 wherein said plurality of projections are dimples.

7. A gas turbine engine component as set forth in claim 3 wherein said radial passage has a bell-mouth shape at an entrance thereto.

8. A gas turbine engine component as set forth in claim 3 wherein said cooling means includes a plurality of passages formed from a refractory metal core in said fillet cavity.

9. A gas turbine engine component as set forth in claim 1 wherein said airfoil has a leading edge cavity and a coolant supply cavity with the coolant supply cavity being supplied with coolant air by way of a coolant supply passage in said fir tree, and said coolant supply cavity being fluidly interconnected to said leading edge cavity by way of a plurality of impingement cooling passages.

10. A gas turbine engine component as set forth in claim 9 wherein said impingement cooling passages have a cross sectional shape in the form of a racetrack.

11. A gas turbine engine component as set forth in claim 9 wherein said airfoil has a pressure side and a suction side and further wherein said plurality of impingement cooling passages are disposed closer to said pressure side than to said suction side.

12. A gas turbine engine component as set forth in claim 9 wherein said impingement cooling passages include a plurality of trip strips to enhance the flow of the cooling air and further wherein each of a plurality of said impingement cooling passages are disposed substantially intermediate a pair of adjacent trip strips.

13. A gas turbine engine component as set forth in claim 9 wherein said airfoil leading edge and said fillet each have a plurality of film cooling holes for conducting the flow of coolant air from an internal cavity to the surface of the blade.

14. A gas turbine engine component as set forth in claim 13 wherein the radial spacing of adjacent film cooling holes in said fillet is less than the radial spacing between adjacent film cooling holes in said blade.

15. A gas turbine engine component as set forth in claim 13 wherein said blade and fillet have a trench formed in the leading edge thereof, said trench being concave toward the leading edge and fluidly communicating with each of said plurality of film cooling holes.

16. A gas turbine engine component as set forth in claim 13 wherein said plurality of film cooling holes include a metering portion and a diffusion portion with said metering portion being disposed near an inner surface of the blade leading edge and said diffusion portion being disposed near the leading edge.

17. A gas turbine engine component as set forth in claim 16 wherein said diffusion portion is cone shaped in its longitudinal cross-sectional shape.

18. A gas turbine engine component, comprising:

an airfoil;

a platform attached to said airfoil and extending in a plane between a leading edge and a trailing edge;

a fillet interconnecting said airfoil to said platform, said fillet extending at an acute angle from said platform plane to form a fillet cavity within said airfoil; and cooling means for providing cooling air to said fillet cavity;

said airfoil having a leading edge cavity and a coolant supply cavity, with the coolant supply cavity being supplied with coolant air by way of a coolant supply passage and said coolant supply cavity being fluidly interconnected to said leading edge cavity by way of a plurality of impingement cooling passages; wherein said impingement cooling passages have a cross-sectional shape in the form of a racetrack.

19. A gas turbine engine component as set forth in claim 18 wherein said airfoil has a pressure side and a suction said and further wherein said plurality of impingement cooling passages are disposed closer to said pressure side than to said suction side.

20. A gas turbine engine component as set forth in claim 18 wherein said coolant supply cavity includes a plurality of trip strips to enhance the flow of the cooling air and further wherein each of a plurality of said impingement cooling passages are disposed substantially intermediate a pair or adjacent trip strips.

21. A gas turbine engine component as set forth in claim 18 wherein said airfoil has a plurality of film cooling holes for conducting the flow of coolant air from said leading edge cavity to a surface of the airfoil and further wherein said film cooling holes include a metering portion and a diffusion portion, with said metering portion being disposed near an inner surface of said leading edge cavity and said diffusion portion being disposed near an outer surface thereof.

22. A gas turbine engine component as set forth in claim 21 wherein said diffusion portion is cone-shaped in its longitudinal cross-sectional shape.

23. A gas turbine engine component as set forth in claim 18 wherein both said airfoil and said fillet have a plurality of film cooling holes for conducting the flow of coolant air from an internal cavity to the surface thereof.

24. A gas turbine engine component as set forth in claim 23 wherein the radial spacing of adjacent film cooling holes in said fillet is less than the radial spacing between adjacent film cooling holes in said blade.

25. A gas turbine engine component as set forth in claim 18 wherein said blade and fillet have a common trench formed in leading edges thereof, said trench being concave toward the leading edges and fluidly communicating with each of said plurality of film cooling holes.

26. A gas turbine engine component as set forth in claim 18 wherein said acute angle is in the range of 10° to 60°.

27. A gas turbine engine component as set forth in claim 18 wherein said cooling means includes a dedicated radial passage for conducting the flow of cooling air into said fillet cavity.

28. A gas turbine engine component as set forth in claim 27 wherein said radial passage is interconnected to said fillet cavity by one or more cross-over passages.

29. A gas turbine engine component as set forth in claim 27 wherein said radial passage has a bell-mouth shape at an entrance thereto.

30. A gas turbine engine component as set forth in claim 18 wherein said fillet cavity has a plurality of projections formed on its inner surface to be cooled by said cooling air.

31. A gas turbine engine component as set forth in claim 30 wherein said plurality of projections are dimples.

32. A gas turbine engine component as set forth in claim 18 wherein said cooling means includes a plurality of passages formed from a refractory metal core in said fillet cavity.

* * * * *

UNITED STATES PATENT AND TRADEMARK OFFICE

CERTIFICATE OF CORRECTION

PATENT NO. : 7,217,094 B2
APPLICATION NO. : 10/967558
DATED : May 15, 2007
INVENTOR(S) : Frank J. Cunha et al.

It is certified that error appears in the above-identified patent and that said Letters Patent is hereby corrected as shown below:

Column 3, Line 60. Please delete the reference to "111" and replace with --11--.

Signed and Sealed this

Seventh Day of August, 2007

JON W. DUDAS
*Director of the United States Patent and Trademark Office*